US006346666B1

(12) United States Patent
Tsai et al.

(10) Patent No.: US 6,346,666 B1
(45) Date of Patent: Feb. 12, 2002

(54) APPARATUS AND METHOD FOR PRACTICE AND EVALUATION OF MUSICAL PERFORMANCE OF CHORDS

(75) Inventors: Tom Jen Tsai; Masahiko Wakita, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/723,198

(22) Filed: Nov. 27, 2000

(30) Foreign Application Priority Data

Nov. 29, 1999 (JP) ..... 11-337172

(51) Int. Cl.[7] ..... G10H 1/38; G10H 7/00
(52) U.S. Cl. ..... 84/637; 84/470 R
(58) Field of Search ..... 84/609, 613, 637, 84/470 R

(56) References Cited

U.S. PATENT DOCUMENTS 5,418,322 A * 5/1995 Minamitaka ..... 84/609
5,510,572 A * 4/1996 Hayashi et al. ..... 84/609
6,084,168 A * 7/2000 Sitrick
6,107,559 A * 8/2000 Weinstock et al. ..... 84/634
6,252,152 B1 * 6/2001 Aoki et al. ..... 84/609

* cited by examiner

*Primary Examiner*—Jeffrey Donels
(74) *Attorney, Agent, or Firm*—Morrison & Foerster LLP

(57) ABSTRACT

A chord performance training system is realized on a personal computer having a display and a keyboard in accordance with music application software. The display provides a user with three types of windows on a screen, namely a main window for displaying chord progression, a select window for displaying a list of genre names for selection and a score window for displaying a score. On the select window, the user selects a specific single genre name to activate model performance information containing chord parts, a percussion part, a chord text and a song text, so that the main window shows chord progression representing chord names and generation timings of chords which are to be sequentially played by the user. Multiple sets of model performance information are provided to suit to different levels, namely a beginners' level and an expert level, which are set to the user in playing chord performance on the keyboard. Incidentally, the select window shows histograms each of which shows a score being marked for user's chord performance out of ten grades with respect to each of the genre names, while the score window shows a highest point of score being marked for the user in the past out of a hundred. The user's chord performance is evaluated in comparison with the model performance information suited to a desired level in consideration of a degree of match being detected between a key-depression pattern and a chord pattern within an allowable time range (e.g., 300 msec).

23 Claims, 13 Drawing Sheets

FIG.18A

KEY-DEPRESSION PATTERN

| C | C# | D | D# | E | F | F# | G | G# | A | A# | B |
|---|---|---|---|---|---|---|---|---|---|---|---|
| 1 | 0 | 0 | 0 | 1 | 0 | 0 | 0 | 1 | 0 | 0 | 0 |

FIG.18B

CHORD PATTERN

| | C | C# | D | D# | E | F | F# | G | G# | A | A# | B |
|---|---|---|---|---|---|---|---|---|---|---|---|---|
| C | 1 | 0 | 0 | 0 | 1 | 0 | 0 | 0 | 1 | 0 | 0 | 0 |
| Cm | 1 | 0 | 0 | 1 | 0 | 0 | 0 | 0 | 1 | 0 | 0 | 0 |
| C7 | 1 | 0 | 0 | 0 | 1 | 0 | 0 | 0 | 1 | 0 | 1 | 0 |
| ⋮ | | | | | | | | | | | | |

APPARATUS AND METHOD FOR PRACTICE AND EVALUATION OF MUSICAL PERFORMANCE OF CHORDS

BACKGROUND OF THE INVENTION

1. Field of the Invention

This invention generally relates to apparatuses and methods for practice and evaluation of musical performance of chords being played by users, and particularly to user-friendly chord performance training systems that assist the users to practice musical performance of chords under evaluation and allow the users to select tunes for practice based on evaluation results. Specifically, this invention relates to methods of musical tone synthesis, performance information selection, performance control and evaluation to suit to practice of musical performance of chords. In addition, this invention also relates to recording media storing programs and data that implement the methods suited to the practice of musical performance of chords.

2. Description of the Related Art

It is well known that personal computers install application programs for use in practice of musical performance of chords. The application programs (namely, music application software) cause the personal computers to reproduce musical performance information representing examples (or models) of musical performance of plural parts containing chord parts. On the basis of performance information (namely, model performance information) of the chord parts, chords to be performed by the users (or keys to be depressed by the users) are sequentially designated by a display or indicators using light-emitting diodes (LEDs), for example.

The aforementioned music application software allow the users to arbitrarily designate actually played parts which are to be actually played within the parts being reproduced. That is, it is possible to produce sounds corresponding to only the chord parts within the performance information, or it is possible to produce sounds corresponding to other parts other than the chord parts. In addition, the users are able to operate keyboards during reproduction of the performance information in progress. In that case, input performance information is produced in response to user's operations of the keyboard and is compared with the model performance information. Thus, the software evaluates skills of the users in playing musical performance in consideration of a degree of match (or conformity) being calculated between the input performance information and model performance information. Incidentally, the users are capable of recording the input performance information on some media (e.g., magnetic recording media, etc.) at any time.

However, the conventional technology suffers from various problems, which will be described below.

The conventional system allows the users to designate the actually played parts within the reproduced parts. However, it is troublesome for the users to make specific setting for selective determination as to whether sound is to be actually produced or not with respect to each of the parts. Normally, beginners of musical performance seldom know detailed contents of the parts. Therefore, it is very difficult for the beginners to make adequate setting for the selective determination as to whether the sound is to be actually produced or not with respect to each of the parts.

If there exist plural tunes that are reproducible, it may be convenient for the users to select the tunes based on evaluation results of performance that is made in the past. However, there are conventionally no systems that allow the users to select the tunes based on the evaluation results of performance in the past.

Some of the tunes contain difficult chords that require highly sophisticated techniques in playing. In some cases, the users, particularly the beginners, wish to play the tunes containing the difficult chords. Practically, before playing those tunes containing the difficult chords, the beginners need practice on other tunes constructed by simple chords that can be played with ease as compared with the difficult chords. However, it takes a relatively long time for the beginners to practice on those tunes of the simple chords, which would be disincentive to the beginners in practice of musical performance of chords.

Conventionally, so-called "software sound sources" are well known to reproduce musical tone waveforms on the personal computers by the software. Normally, the software sound sources provide some time lags in actual generation of musical tones after depression of keys by the users. It is expected that the personal computers would have functions to evaluate musical performance being played by the users. Even if the personal computers actualize the functions of evaluation of musical performance, the users may have feelings of wrongness due to the time lags inherently caused by the software sound sources. Conventionally, engineers do not particularly propose measures for elimination of the time lags of the software sound sources.

As described before, the users are capable of recording input performance information on media by performing prescribed operations on the personal computers or else. However, the personal computers installing the conventional music software merely allow the users to unconditionally record the input performance information on the media. Hence, it is hard for the users to realize achievement in improvement of skills in musical performance by recording.

It is not always preferable that the input performance information normally match with the model performance information. That is, the users are not always required to accurately play the chords as designated by the model performance information, in other words, it is preferable that some of the chords are being played in inversion, regardless of designation of the model performance information. If the users play "inverted chords" which differ from original chords of the model performance information in pitch, the conventional system evaluates the users to incorrectly play the chords. Namely, the conventional system has difficulties in adaptively and adequately evaluating skills of the users in playing musical performance of chords.

SUMMARY OF THE INVENTION

It is an object of the invention to provide an apparatus and a method for practice and evaluation of musical performance of chords, which is realized in a form of a user-friendly chord performance training system that assists users to practice musical performance of chords and that provide adequate and adaptive evaluation on a skills of the users in playing musical performance, so that the users are capable of adequately selecting tunes for practice based on evaluation results for performance made in the past.

This invention provides a chord performance training system which is realized on a personal computer having a display and a keyboard in accordance with music application software. The display provides a user with three types of windows on a screen, namely a main window for displaying chord progression, a select window for displaying a list of genre names for selection and a score window for displaying a score. On the select window, the user selects a specific single genre name to activate model performance information containing chord parts, a percussion part, a Chord text and a song text, so that the main window shows chord progression representing chord names and generation timings of chords, which are to be sequentially played by the user and are updated. The user plays the keyboard to produce input performance information while watching the chord progression being displayed on the main window based on the model performance information. The select window shows histograms in connection with the genre names respectively, wherein each of the histograms shows a score being marked in the past for the input performance information made by the user out of ten grades in comparison with the model performance information, whereas the score window shows a highest point of score being marked for the user in the past out of a hundred. Multiple sets of model performance information are provided to suit to different levels, namely a beginners' level and an expert level, which are set to the user in playing chord performance on the keyboard.

When the user plays a chord on the keyboard with reference to the model performance information suited to a desired level, a key-depression pattern is produced to designate notes of depressed keys within prescribed twelve notes corresponding to one octave of the keyboard as input performance information and is compared with a chord pattern that represents prescribed notes of the chord corresponding to prescribed keys which should be simultaneously depressed within the prescribed twelve notes. Thus, the input performance information is evaluated by marking a score in consideration of a degree of match being detected between the key-depression pattern and chord pattern within an allowable time range (e.g., 300 msec).

The system provides two operation modes, namely a solo mode and a mute mode. In the solo mode, the system initiates reproduction on the chord parts and percussion part, so that the user is capable of playing chords on the keyboard while watching the chords being sequentially displayed and updated on the main window and listening to percussion sounds being reproduced based on the percussion part. This allows the user to easily play the chords with rhythm and time being sensed by the percussion sounds. In the mute mode, the system initiates reproduction on other parts other than the chord parts. Incidentally, the system allows the user to initiate or inhibit generation of musical tones of chords and/or percussion sounds according to needs.

BRIEF DESCRIPTION OF THE DRAWINGS

These and other objects, aspects and embodiment of the present invention will be described in more detail with reference to the following drawing figures, of which:

FIG. 18A shows a key-depression pattern being created in response to depression of keys on a keyboard by the user; and FIG. 18B shows a chord pattern which is read out in connection with model performance information and is compared with the key-depression pattern.

DESCRIPTION OF THE PREFERRED EMBODIMENT

This invention will be described in further detail by way of examples with reference to the accompanying drawings.

[A] Hardware Configuration

Figure 1:
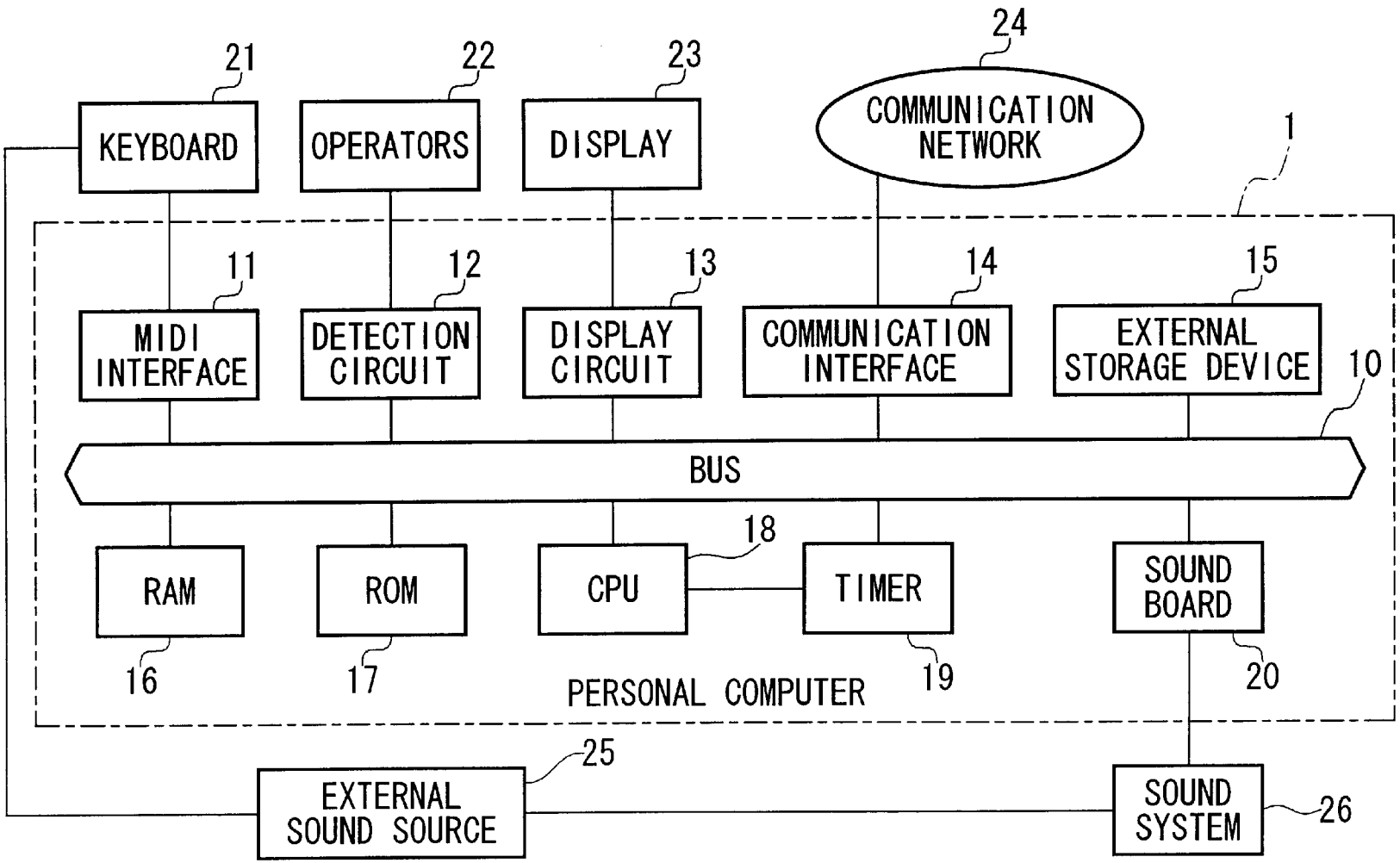
FIG. 1 is a block diagram showing a configuration of a chord performance training system that is realized using a personal computer running software programs in accordance with a preferred embodiment of the invention.

FIG. 1 shows an example of a hardware configuration in accordance with a preferred embodiment of the invention. Actually, the preferred embodiment is realized by a general-purpose personal computer 1 that actualizes a chord performance training system.

In FIG. 1, a central processing unit (CPU) 18 controls several parts and components built in the personal computer 1 via a bus 10 in accordance with control programs, details of which will be described later.

A keyboard 21 is connected with the personal computer 1 via a MIDI interface 11 (where "MIDI" is the known standard for "Musical Instrument Digital Interface") and is used to produce performance information, which is supplied to the personal computer 1. A reference numeral 22 designates operators including keys, switches and a mouse which are manually operated by a user, for example. The operators 22 are used to produce and designate various kinds of operation information, which are input to the CPU 18 by way of a detection circuit 12. A display 23 displays on a screen various kinds of information contents for the user under control of a display circuit 13.

The personal computer 1 contains a communication interface 14 that is used to perform communications of various kinds of information and data with a communication network 24. An external storage device 15 is configured by a floppy-disk drive, a hard-disk drive, a magneto-optic (MO) disk drive or else. The external storage device 15 stores an operating system and a chord practice application program as well as performance information. A read-only memory (ROM) 17 stores an initial program loader that loads the operating system into the personal computer 1 to start processing.

A random-access memory (RAM) 16 is accessible by the CPU 18 to read or write data. A timer 19 is coupled to the CPU 18 to generate timer interrupt signals. A sound board 20 fabricating integrated circuits and components converts digital signals, which represent musical tone waveforms and are produced by the CPU 18, to analog signals. Based on the analog signals output from the sound board 20, the sound system 26 generates musical tones corresponding to the musical tone waveforms.

A reference numeral 25 designates an external sound source, which is externally provided for the personal computer 1. The external sound source 25 is used to synthesize (external) musical tone waveforms based on performance information which is output from the keyboard 21. Thus, the sound system 26 is capable of generating musical tones corresponding to the external musical tone waveforms as well. Incidentally, the external sound source 25 is not an essential constituent element for the present embodiment. Hence, it is possible to exclude the external sound source 25 from the chord performance training system of FIG. 1.

[B] Data Configurations (1) File Configuration

Figure 6:
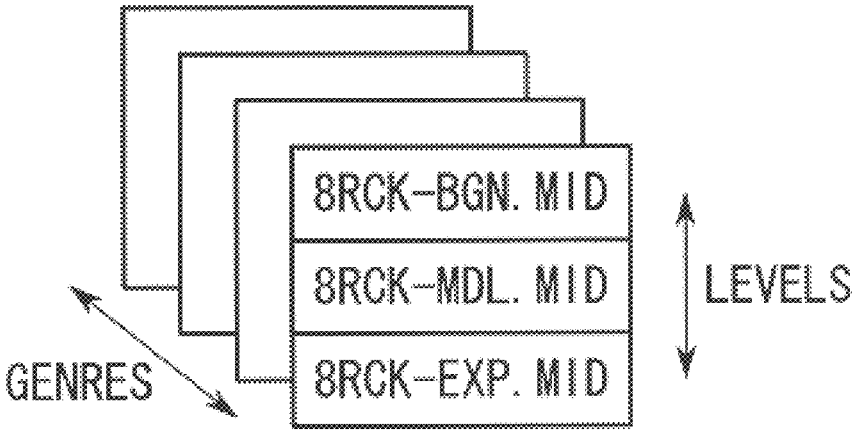
FIG. 6 shows a file configuration of performance information.

An example of a file configuration employed by the present embodiment will be described with reference to FIG. 6. The present embodiment employs a specific file format for performance information, namely an SMF format (i.e., standard MIDI file format). According to prescribed rules of the aforementioned file format, each file is named with an extension of ".MID".

A main part of a file name other than the extension is expressed by two parts connected by a hyphen, namely, a first part represents a genre name, and a second part following the hyphen represents a level. Herein, the genre name corresponds to a name of a musical tune, i.e., a string of characters that simplify a name of a musical tune. In addition, the level corresponds to a level of difficulty in playing. In connection with each single genre name, there are provided three kinds of levels, namely, a beginners' level "BGN", a middle level "MID" and an expert level "EXP".

(2) File Content

Figure 7:
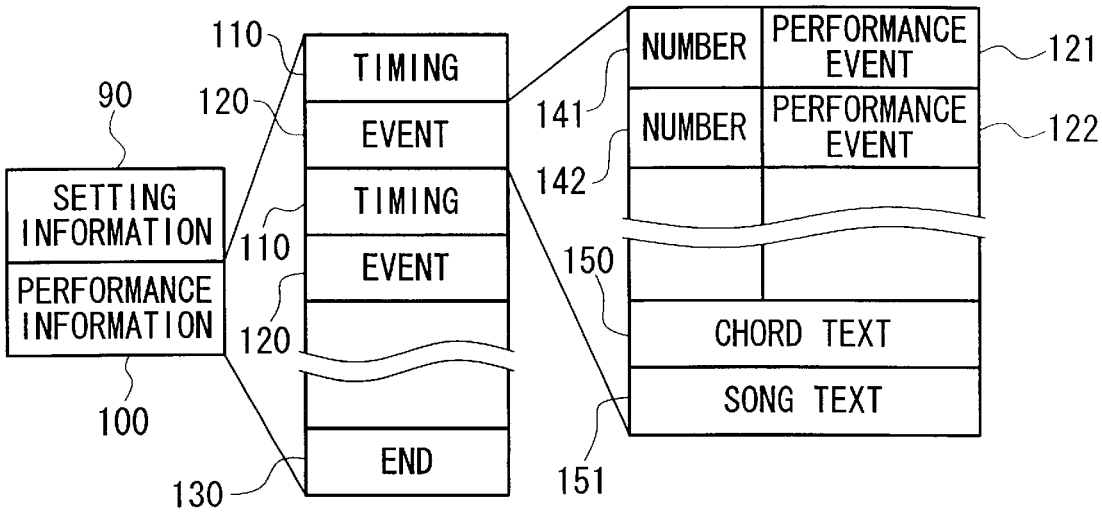
FIG. 7 shows a data configuration of the performance information.

FIG. 7 shows contents of files for representation of performance information. Namely, a performance information file is basically configured to include setting information 90 and performance information 100. Herein, the setting information 90 correspond to various types of initial setting information regarding reproduction of a musical tune, which define a tempo value, a master volume value and tone colors being set for parts.

The performance information 100 corresponds to an SMF format "0", which is configured to include plural timing data 110, plural event data 120 and end data 130. Herein, each of the timing data 110 is followed by each of the event data 120, and all of the timing data 110 and event data 120 within the performance information 100 are terminated by the end data 130.

The timing data 110 designate reproduction timings for events of the event data 120. In addition, the end data 130 designates an end position of the musical tune. The event data 120 represent contents of the events. For convenience' sake, FIG. 7 shows a series of events which may be sequentially reproduced at different timings for a single part. Of course, it is possible to store in the performance information 100 multiple parts of events which are to be reproduced at same timings.

Specifically, each single event data 120 contain a single performance event or multiple performance events 121, 122, . . . Each of the performance events corresponds to a note-on event, a note-off event or else, which is related to reproduction of sound (e.g., note) of the musical tone. The performance events 121, 122, . . . are respectively preceded by number sections 141, 142, . . . , which store numbers of parts (corresponding to MIDI channel numbers).

That is, specific integral numbers are respectively assigned to the parts of the musical tune. For example, "part 4" and "part 5" are chord parts which are respectively played with right and left hands of the user by a tone color of a piano, and "part 10" is a part of percussion sound. As for the other parts, there are provided a part of melody sound and a part of accompaniment sound.

In addition, a chord text section 150 is provided to sequentially store chord names in connection with the content of the part 4 or 5 in accordance with progression of chord performance. That is, if events regarding the chord part 4 or 5 are included in the performance events 121, 122, . . . , chord names such as "E", "E7" and "EM9" are stored in the chord text section 150 in a text form. Further, a song text section 151 is provided to sequentially store words (or lyric) of a song text in accordance with progression of musical performance. If there are provided a string of characters of words which are to be produced by voices at designated timings, those characters are stored in the song text section 151 in a text form.

(3) Examples of Chord Event Information

Next, examples of chord event information which are provided in response to different levels for user's skills will be described with reference to FIGS. 8 to 10.

Figure 8:
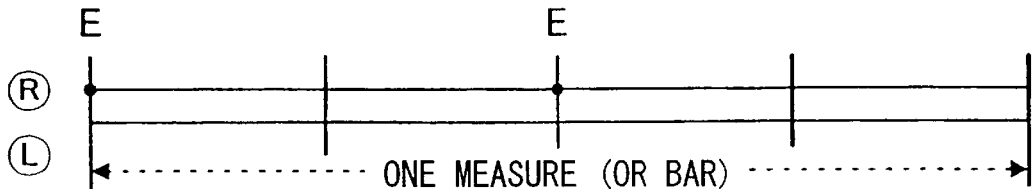
FIG. 8 shows a chord part designating chords being played in a single measure in accordance with chord event information for use in a beginners' level.
Figure 9:
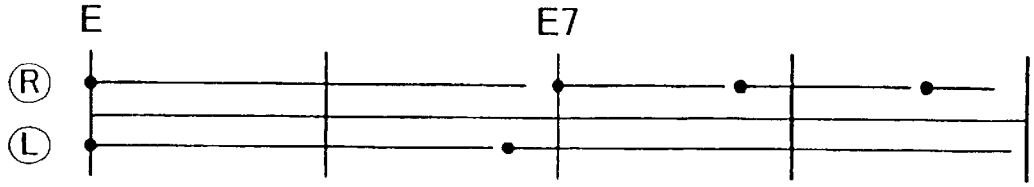
FIG. 9 shows chord parts designating chords being played in a single measure in accordance with chord event information for use in a middle level.
Figure 10:
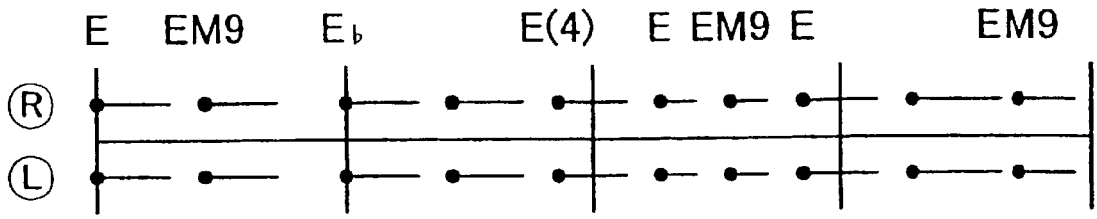
FIG. 10 shows chord parts designating chords being played in a single measure in accordance with chord event information for use in an expert level.

FIGS. 8 to 10 show measures (or bars) each consists of four beats in connection with prescribed chords such as "E", "E7" and "EM9", wherein each of vertical lines designate each of beat timings. In addition, characters representing the prescribed chords represent chord names being stored in the chord text section 150. Further, black point marks included in each measure designate note-on timings (or generation timings of chords). Furthermore, a line segment that extends in a rightward direction from each black mark in the figure designates a chord sustain time during which a chord sound is being sustained. Moreover, marks of "R" and "L" designate a right-hand part and a left-hand part respectively.

FIG. 8 shows an example of chord event information which is suited to the beginners' level to substantially instruct chord performance being made with a right hand only. Herein, the chord event information is set such that each note-on timing is forced to coincide with each beat timing as accurately as possible and each chord sustain time is forced to match with integer multiples of a beat period (i.e., an interval of time between consecutive beat timings) as accurately as possible.

FIG. 9 shows an example of chord event information which is suited to the middle level in which the user plays chord performance by using both of right and left hands. In the chord performance, a right-hand part instructs the user to sound two types of chords that include a chord having an attribute of "7th" (i.e., E7) in addition to a simple chord "E", while a left-hand part instructs the user to sound chord roots. In addition, note-on/off timings are set to suit to a feeling (or atmosphere) of a tune to some extent. As a result, some of the note-on timings are slightly shifted from beat timings.

FIG. 10 shows an example of chord event information which is suited to the expert level in which the user plays chord performance by using both of right and left hands in a highly sophisticated manner. In the chord performance, a right-hand part instructs the user to sound various types of chords that include so-called tension chords, while a left-hand part instructs the user to sound various types of chords that may include chord names accompanied with flat and sharp (not shown specifically). In addition, note-on/off timings are set to suit to a feeling (or atmosphere) of a musical tune with a delicacy.

Chords used in the aforementioned levels are stored in the chord text section 150 in connection with the parts 4 and 5. As for the part 10 or other parts, the chord text section 150 stores same information with respect to the same genre (or same tune), regardless of differences of the levels.

[C] Operations and Processing

Next, operations and processing of the present embodiment will be described with reference to the accompanying drawings.

(1) Starting Chord Performance Training Application

When power is applied to the personal computer 1 to start operation, the initial program loader stored in the ROM 17 is activated to start the operating system. So, when the user makes prescribed operations on the operating system, the personal computer 1 starts to run a chord performance training application (program), an outline of which is shown in FIG. 2.

Figure 2:
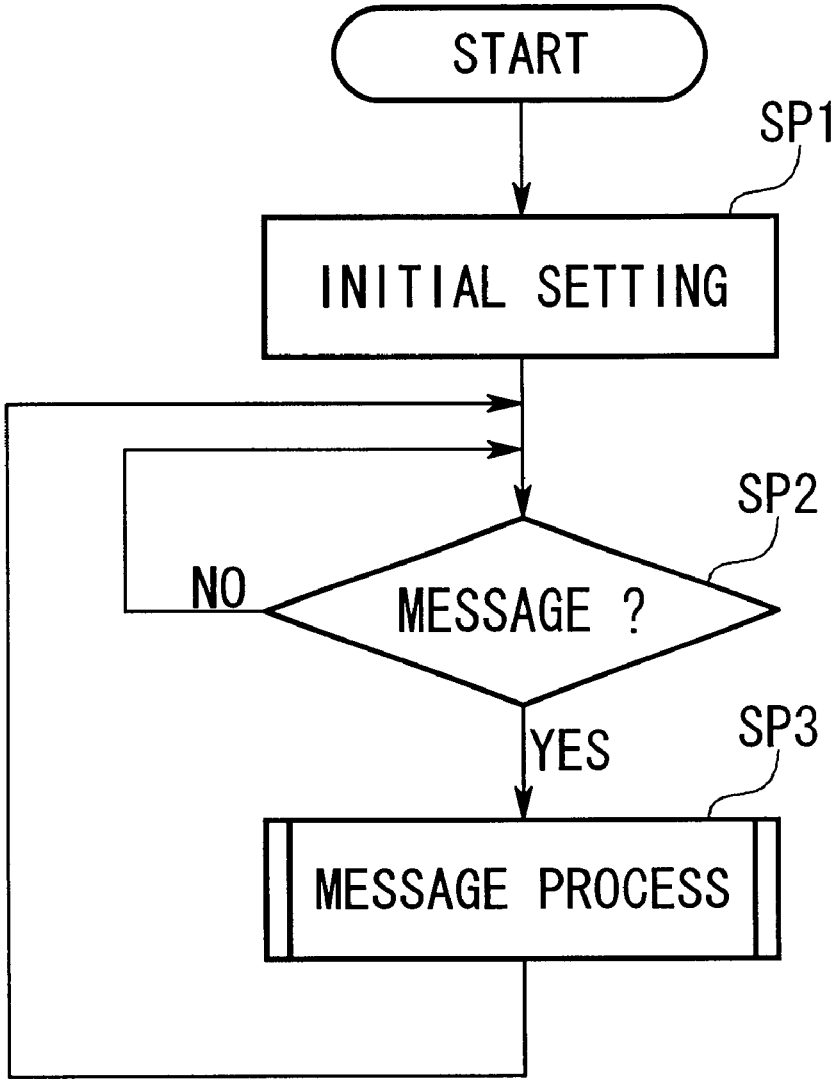
FIG. 2 is a flow chart showing a main routine to be executed by the personal computer.

In FIG. 2, when a flow proceeds to step SP1, the chord performance training system (hereinafter, simply referred to as the system) performs initial setting which is determined in advance. Herein, the system displays on a screen of the display 23 a main window 40 (see FIG. 3) of the chord performance training application. In step SP2, the system is placed in a standby state which is sustained until receipt of some message(s) being given from the operating system. Upon receipt of a certain message, the flow proceeds to step SP3 to call a routine (details of which will be described later) in response to the message.

As described above, the system repeatedly performs the steps SP2 and SP3. If the prescribed window (e.g., main window 40) of the chord performance training application contains a focus (e.g., a dialog box that is ready to receive input from the keyboard or else), a prescribed event such as a keyboard event and a mouse event that occurs on the operators 22 is communicated from the operating system to the chord performance training application as the foregoing message. Similarly, when an interrupt event such as a timer interrupt event occurs, occurrence of such an interrupt is communicated to the chord performance training application as well. Incidentally, discussion will be given later with respect to details of processes to be executed in response to various events.

Now, a description will be given with respect to details of the main window 40 displayed on the screen of the display 23. The main window 40 contains a chord progression display area 41 that shows chord names of chords, which are played by right and left hands respectively, and note-on timings (indicated by black point marks) for generation of the chords on the basis of stored contents of the chord text section 150 within the performance information being reproduced. In the chord progression display area 41, the chord names and note-on timings are shown above or on lines which designate measures belonging to a right-hand part and a left-hand part respectively, wherein as similar to FIGS. 8 to 10, vertical lines represent beat timings. A lowermost area of the chord progression display area 41 shows words (actually, Japanese words) of a song text on the basis of stored contents of the song text section 151.

Since the chord progression display area 41 shows chords and words in the measures of the right-hand part and left-hand part which are presently played, displayed contents are sequentially updated in accordance with progression of the musical tune. A reference numeral 51 designates a keyboard indicator area that shows a figure simulating a keyboard consisting of white keys and black keys, which are configured by indicators. As the keys are to be depressed in accordance with chords being presently played, the indicators are correspondingly turned on. The main window 40 provides a number of buttons, which are operated by the user with clicks of the mouse. Herein, there are provided two types of mode buttons, namely, a solo button 42 and a mute button 43, which are used to set a solo mode and a mute mode respectively. Incidentally, details of the aforementioned modes will be described later.

A reference numeral 44 designates a song select button, which is operated by the user so that the system displays a select window 60 (see FIG. 4) on the screen of the display 23. A reference numeral 45 designates a MIDI setup button, which is operated by the user to establish setting as to whether the personal computer 1 outputs input performance information given from the keyboard 21 via the sound board 20 or not. A reference numeral 47 designates a start button, which is operated by the user to instruct the system to start reproduction of performance information. A reference numeral 49 designates a stop button, which is operated by the user to instruct the system to stop reproduction of the performance information.

In the system of the present embodiment, there is provided a RUN flag representing a decision as to whether automatic reproduction (or auto playback) of the performance information is to be executed or not. So, when the user clicks the start button 47 with the mouse, the RUN flag is set to "1". When the user clicks the stop button 49 with the mouse, the RUN flag is set to "0". In addition, there are provided a rewind button (or quick reverse button) 46 and a fast forward button 48. Further, a reference numeral 50 designates a record button, which is operated by the user to instruct the system to start recording of input performance information.

(2) Event Process of MIDI Setup Button 45

Figure 11:
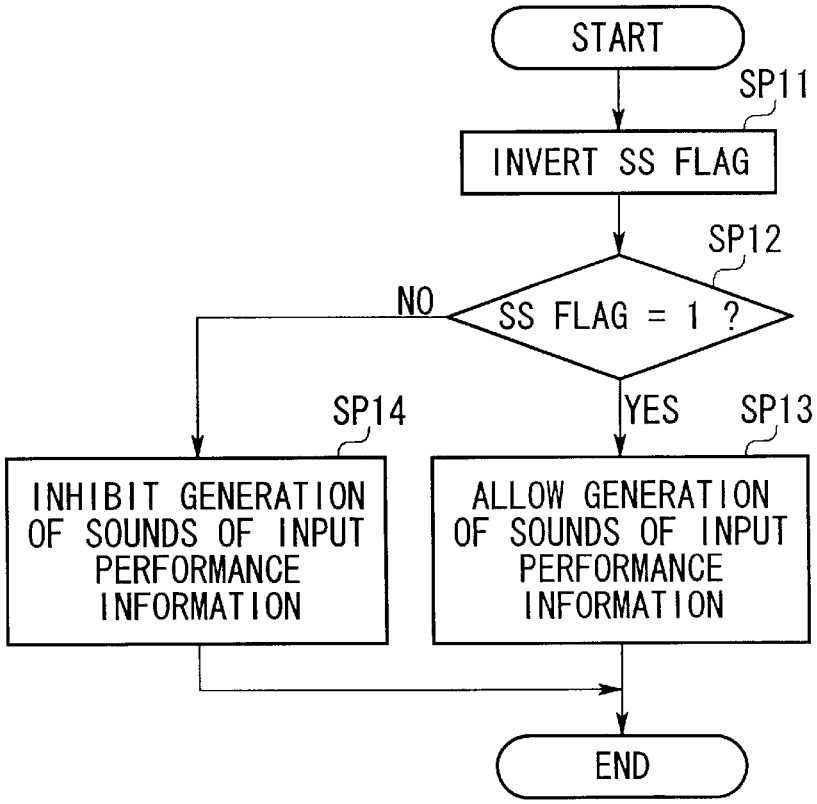
FIG. 11 is a flow chart showing an event process routine of a MIDI setup button on the main window of FIG. 3.

An event process of the MIDI setup button 45 being operated in the chord progression display area 40 will be described with reference to FIG. 11. That is, when the user clicks the MIDI setup button 45 with the mouse, the system starts a routine shown in FIG. 11. In FIG. 11, a flow firstly proceeds to step SP11 in which an SS flag is inverted. Due to the initial setting in the foregoing step SP1 shown in FIG. 2, the SS flag is originally set to "1". In step SP12, a decision is made as to whether the SS flag is set to "1" or not.

If "YES" in step SP12, the flow proceeds to step SP13 in which the system is allowed to proceed to generation of musical tones based on input performance information, which is produced by the keyboard 21 and is input by way of the MIDI interface 11, by use of an internal software sound source (not shown specifically in FIG. 1). If "NO" in step SP12, the flow proceeds to step SP14 in which the system is inhibited from generating musical tones based on the input performance information. After completion of the step SP13 or SP14, the routine of FIG. 11 is ended. Thus, by clicking the MIDI setup button 45 with the mouse, the user is capable of turning on or off generation of musical tones of the input performance information by use of the internal software sound source.

Next, a description will be given with respect to significance of the system that allows the user to turn on or off generation of musical tones of the input performance information. In the present embodiment installing the software sound source that musical tone waveforms are created by the software run by the personal computer, certain time lags occur between key depression timings made by the user and tone generation timings. It is a fact that some users may have feelings of wrongness or offensive sensitivities in playing keyboards or else due to the aforementioned time lags. If the user is able to provide an external sound source (25) whose operation and performance are satisfactory, it is preferable to use such an external sound source having a good response.

Because of the aforementioned reason, if the user wishes to use the external sound source having a good response, the present embodiment offers extensibility of the system that allows the user to additionally install the external sound source (25) with the personal computer 1. Herein, the external sound source synthesizes musical tone waveforms based on input performance information of the keyboard 21, so that the sound system 26 is capable of directly generating musical tones based on the musical tone waveforms without intervention of the software sound source of the personal computer 1. Switching in generation of musical tones between the external sound source 25 and the software sound source of the personal computer 1 can be made by a simple operation in which the user merely clicks the MIDI setup button 45 with the mouse on the main window 40. Regardless of determination whether to use the external sound source 25 or not, the input performance information of the keyboard 21 is normally sent to the personal computer 1 via the MIDI interface 11. Hence, in any cases, the personal computer 1 performs evaluation (details of which will be described later) on the input performance information which is made by the user who plays the keyboard 21.

(3) Event Processes of Solo Button 42 and Mute Button 43

Figure 12:
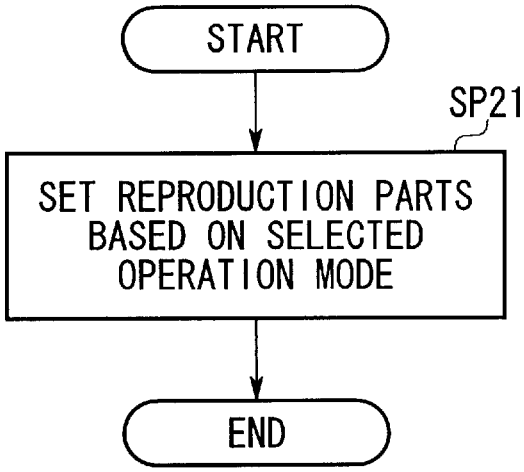
FIG. 12 is a flow chart showing an event process routine of a solo button or a mute button on the main window.

When the user clicks the solo button 42 or the mute button 43 with the mouse on the main window 40, the system starts a routine shown in FIG. 12. In FIG. 12, a flow proceeds to step SP21 in which an operation mode is selected in response to the button being operated, so that a reproduction part (or reproduction parts) is correspondingly set by the system. Herein, the system automatically sets prescribed reproduction part(s) suited to the selected operation mode. In the solo mode being selected when the user operates the solo button 42 on the main window 40, the system selects only the chord parts 4, 5 and the part 10 regarding percussion sound as the reproduction parts whose sounds are to be actually produced.

In the mute mode being selected when the user operates the mute button 43 on the main window 40, the system is capable of selecting all parts other than the chord parts 4, 5 as the reproduction parts whose sounds are to be actually produced.

Next, a description will be given with respect to significance for reproduction of the part 10 regarding the percussion sound in the solo mode. The sole mode is originally provided for the user to practice chord performance while listening to chord sounds of the model performance information. However, if the system actually produces the chord sounds only, there is a problem in that the user is hard to recognize rhythm and time on the chord performance.

In order to provide the user with the rhythm and time on the chord performance, the present embodiment is designed to allow reproduction of the percussion sound even in the solo mode. In addition, reproduction of the percussion sound can be designated by a simple one-touch operation in which the user merely clicks the solo button 42 with the mouse. So, the user does not have confusion as to which part is related to chords or percussion sound when playing chord performance in the solo mode because the system automatically offers optimal parts for the user to play in the solo mode. Thus, even the beginner is capable of certainly and promptly selecting the optimal parts for the chord performance in the solo mode.

(4) Event Process of Song Select Button 44

Figure 3:
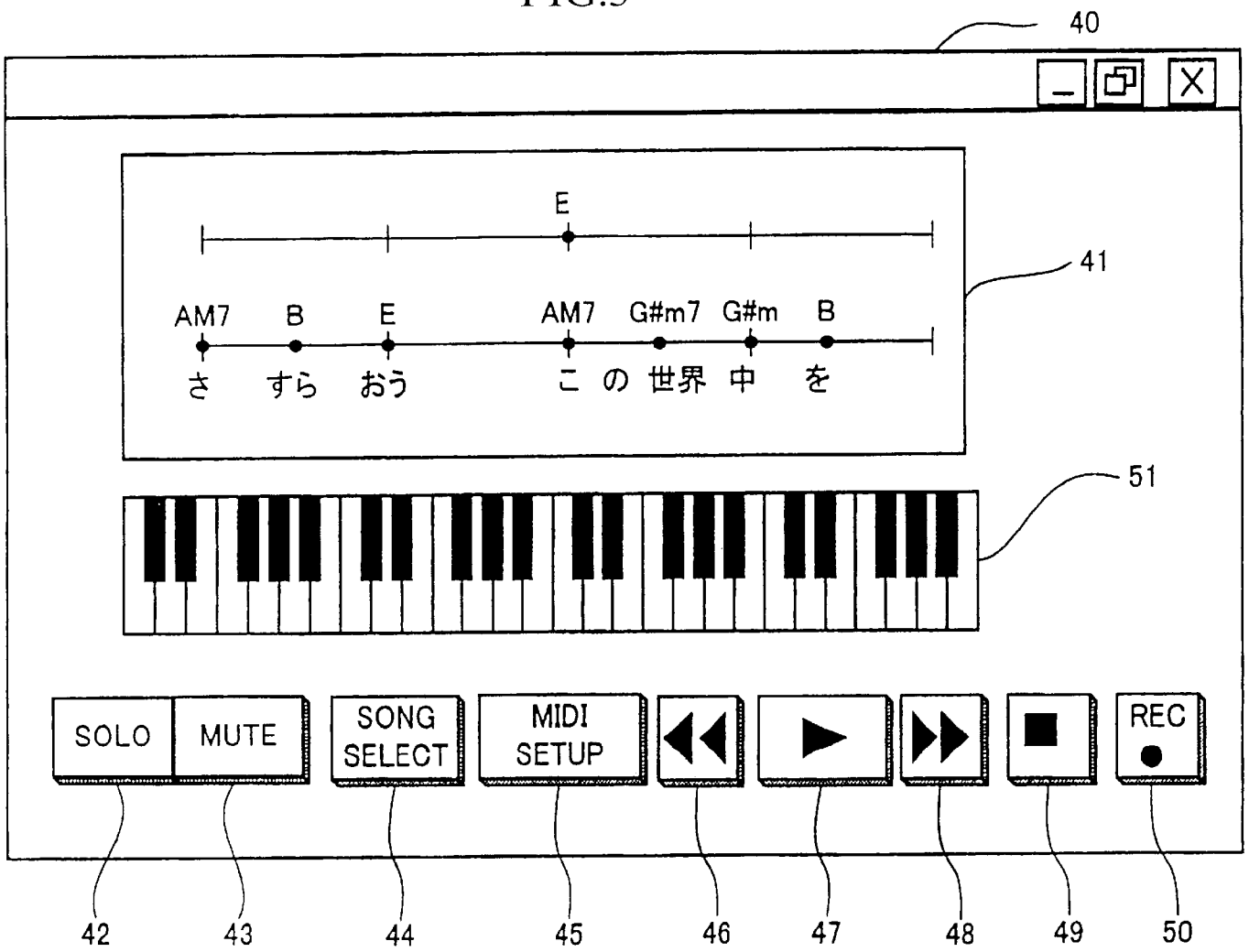
FIG. 3 is an illustration showing an example of a main window which is displayed on a screen of a display.
Figure 4:
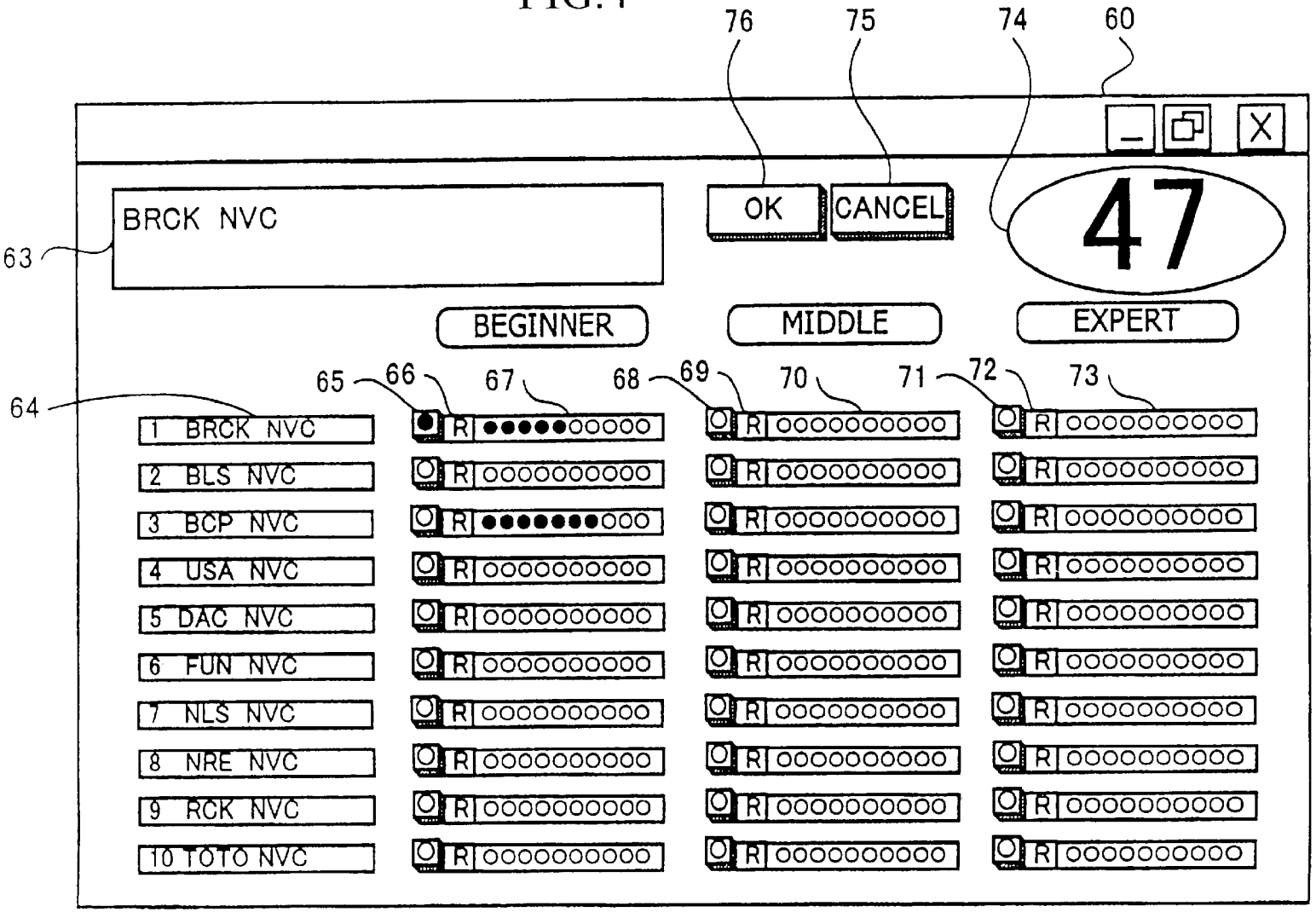
FIG. 4 is an illustration showing an example of a select window which is displayed on the screen upon an operation of a song select button on the main window.

When the user clicks the song select button 44 on the main window 40 (see FIG. 3) with the mouse, the system displays on the screen of the display 23 the select window 60 shown in FIG. 4. In FIG. 4, a reference numeral 64 designates a genre display area that shows genre names corresponding to strings of characters representing or simplifying names of musical tunes. The genre display area 64 contains ten genre display boxes, which are arranged in a vertical direction of the select window 60.

In connection with the ten genre display boxes 64, the select window 60 provides ten select buttons 65 for the beginners to select performance information, which are arranged in a vertical direction. On right sides of the select buttons 65, there are provided record indicators 66 which are turned on (or highlighted) or off in response to ENABLE flags (whose details will be described later). Each of the ENABLE flags is provided for each performance information, wherein each record indicator 66 is turned on when the ENABLE flag is set to "1", while it is turned off when the ENABLE flag is set to "0". The ENABLE flag corresponds to determination as to whether input performance information received by the MIDI interface 11 is to be recorded or not. In connection with the beginners' selection buttons 65, there are provided score display areas 67, each of which shows a highest point of score being marked for the user out of ten grades in a histogram with respect to performance information made by the user in the beginners' level.

As described above, the select window 60 provides users of the beginners' level with the select buttons 65, record indicators 66 and score display areas 67 in connection with the ten genre display boxes 64 respectively. Similarly, the select window 60 provides users of the middle level with select buttons 68, record indicators 69 and score display areas 70, and it also provides users of the expert level with select buttons 71, record indicators 72 and score display areas 73. On the select window 60, the aforementioned buttons, indicators and areas are arranged in columns in connection with the beginners' level, middle level and expert level being sequentially arranged in a horizontal direction. In short, all the buttons, indicators and areas are arranged in a matrix-like form consisting of rows and columns (namely, ten rows and three columns), wherein rows correspond to genre names (see genre display boxes 64) while columns correspond to the levels of the users. On such a matrix-like form, the users are capable of grasping highest points of scores made in the past and records of the input performance information in connection with the ten genre names.

A reference numeral 63 designates a selected genre name display area that shows a genre name of performance information being selected by the user. A reference numeral 76 designates an OK button, which is operated by the user to enter user's selection of the performance information (or genre name). So, when the user clicks the OK button 76 with the mouse, the system closes the select window 60 by accepting the user's selection of the performance information. A reference numeral 75 designates a cancel button, which is operated by the user to discard the user's selection of the performance information. So, when the user clicks the cancel button 75 with the mouse, the system closes the select window 60 by discarding the user's selection of the performance information.

A reference numeral 74 designates a numeric score display area that shows a highest point of score being marked for the user with respect to the selected performance information. Basically, the system evaluates each input performance information of the user to mark a score out of a hundred. The aforementioned score display areas 67, 70 and 73 show scores out of ten grades, which are calculated from scores being marked out of a hundred. The numeric score display area 74 specifically shows a highest point of score being marked for the user by an integral number out of a hundred.

Figure 13:
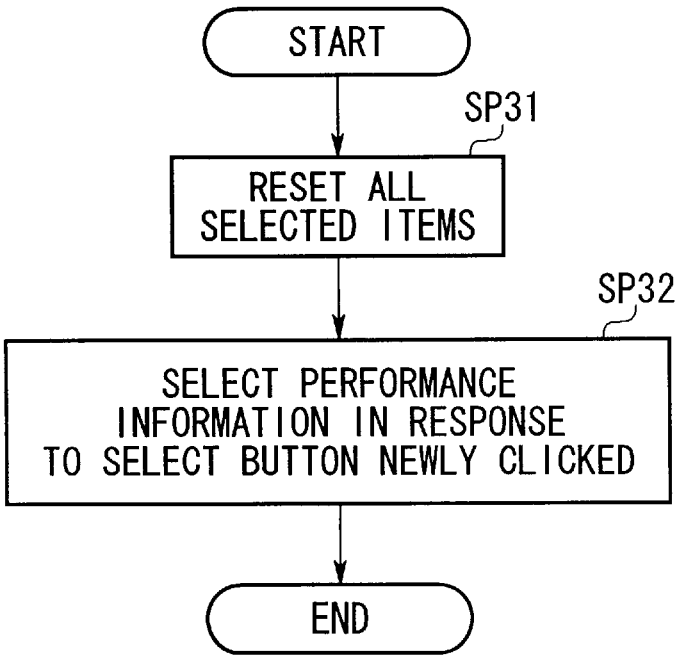
FIG. 13 is a flow chart showing an event process routine of a select button on the select window.

When the user clicks any one of the select buttons 65, 68 and 71 with the mouse on the select window 60, the system starts a routine shown in FIG. 13. In FIG. 13, a flow firstly proceeds to step SP31 in which all items being presently selected are reset. In next step SP32, performance information corresponding to the select button 65, 68 or 71 newly clicked with the mouse is placed in a selected condition. That is, the system turns on (or highlights) the select button 65, 68 or 71 which is newly clicked by the user with the mouse. In addition, the system updates displayed contents of the selected genre name display area 63 and numeric score display area 74 in response to the newly clicked select button.

In other words, when each of the select buttons 65, 67 and 71 is being clicked with the mouse, it is exclusively placed in a selected condition or it is highlighted on the select window 60. In the case of FIG. 4, the select button 65 is operated by the user in the beginners' level so that its performance information is selected with respect to a first genre name of "BRCK NVC" displayed in the first genre name display box 64. After the user completes selection of the aforementioned performance information by clicking the select button 65 with the mouse, the user clicks the OK button 76 with the mouse to enter the performance information into the system. Then, the system closes the select window 60 and reopens the main window 40 again on the screen of the display 23.

On the main window 40 shown in FIG. 3, the chord progression display area 41 shows performance timings (i.e., black point marks) of chords of chord parts 4, 5 together with chord names based on the chord text section 150, and it is capable of showing words of a song text based on the song text section 151 as well. As similar to the foregoing display forms shown in FIGS. 8 to 10, the chord progression display area 41 shows the performance timings of the chords of the chord parts 4, 5 as well as the chord names based on the chord text section 150. In addition, if the performance information presently selected is related to a song text to correspondingly include a song text section (151), the chord progression display area 41 shows words of the song text in connection with the chords and chord names.

(5) Event Process of Record Button 50

Figure 14:
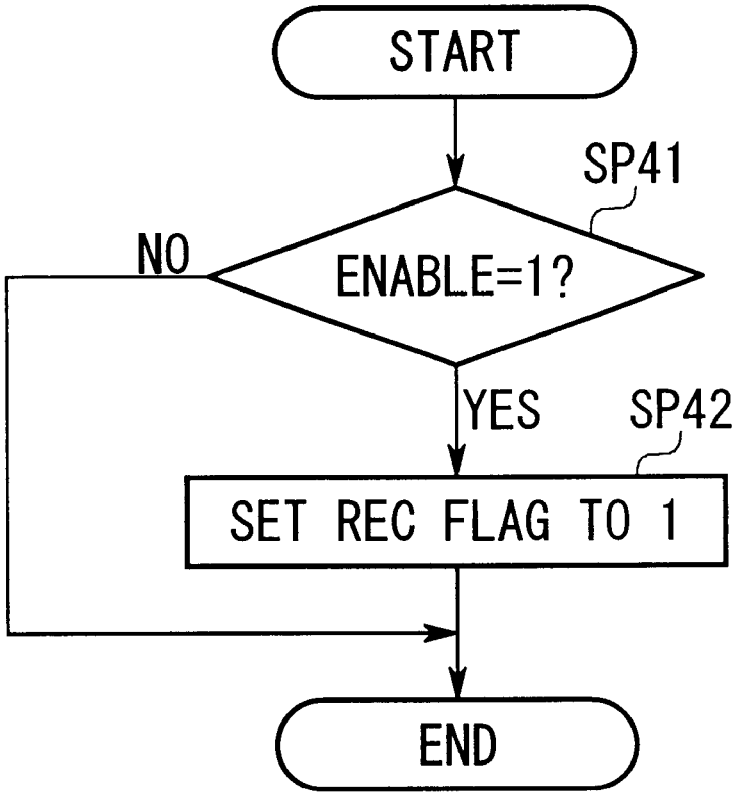
FIG. 14 is a flow chart showing an event process routine of a record button on the main window.

When the user clicks the record button 50 with the mouse on the main window 40, the system starts a routine shown in FIG. 14. In FIG. 14, a flow firstly proceeds to step SP41 in which a decision is made as to whether an ENABLE flag regarding the selected performance information is set to "1" or not. If "NO", the system ends this routine without substantially executing its event process.

If "YES" in step SP41, the flow proceeds to step SP42 in which a REC flag is set to "1". Herein, the REC flag represents determination whether to record the input performance information or not. Under an initial condition, the REC flag is set to "0". After completion of the step SP42, the system ends the routine of FIG. 14.

(6) Timer Interrupt Process During Reproduction

Figure 15:
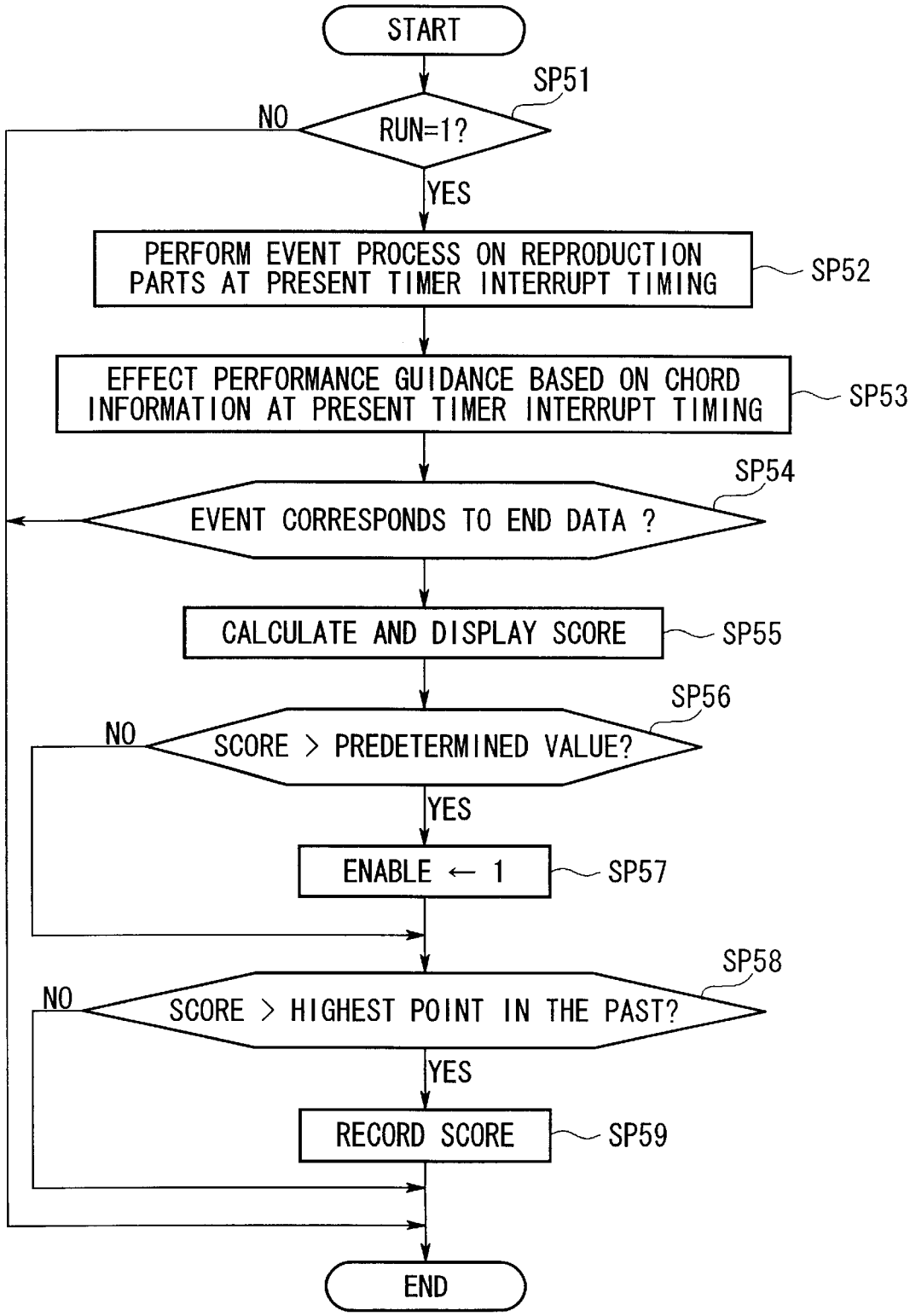
FIG. 15 is a flow chart showing a timer interrupt process routine.

The present embodiment causes timer interrupts to occur by prescribed times by the timer 19. Every time the timer interrupt occurs, the system starts a routine shown in FIG. 15. In FIG. 15, a flow firstly proceeds to step SP51 in which a decision is made as to whether a RUN flag is set to "1" or not. If "NO", the system immediately ends this routine without substantially executing its timer interrupt process.

The RUN flag is set to "1" if the user clicks the start button 47 in advance. In that case, a decision result is "YES" in step SP51, so that the flow proceeds to step SP52. In step SP52, the system reads out performance information which is subjected to reproduction in progress, so that the system performs an event process on reproduction parts at a present timer interrupt timing. That is, the system starts synthesis of musical tone waveforms in response to the event presently designated, so that the synthesized musical tone waveforms are supplied to the sound system 26 via the sound board 20. Thus, the sound system 26 produces musical tones corresponding to the synthesized musical tone waveforms.

In the above, if the user designates the solo mode as the operation mode, musical tone waveforms are synthesized with regard to the chord parts 4, 5 and the part 10 regarding percussion sound. In the mute mode, musical tone waveforms are synthesized with regard to all parts other than the chord parts 4, 5. Incidentally, if no event is designated for the reproduction parts at the present timer interrupt timing, the system does not substantially perform the aforementioned process of the step SP52.

In step SP53, the system effects performance guidance on the basis of chord information at the present timer interrupt timing, namely, chord performance information regarding the chord parts 4, 5. Based on the chord performance information, the system effects a keyboard indicator sequence for sequentially turning on and off indicators of the keyboard indicator area 51 on the main window 40 shown in FIG. 3. In addition, the chord progression display area 41 sequentially updates chord names and words being displayed based on the chord text section 150 and song text section 151.

If no chord information exist for reproduction at the present timer interrupt timing so that none of the chord text section 150 and song test section 151 is provided in the performance information, the system does not substantially perform the aforementioned process of the step SP53. After completion of the step SP53, the flow proceeds to step SP54 in which a decision is made as to whether the event designated at the present timer interrupt timing corresponds to end data (130, see FIG. 7) or not. If the performance information have not yet reached the end data 130 during reproduction in progress, a decision result of step SP54 is "NO", so that the system terminates execution of this routine.

(7) Keyboard Event Interrupt Process

Figure 16:
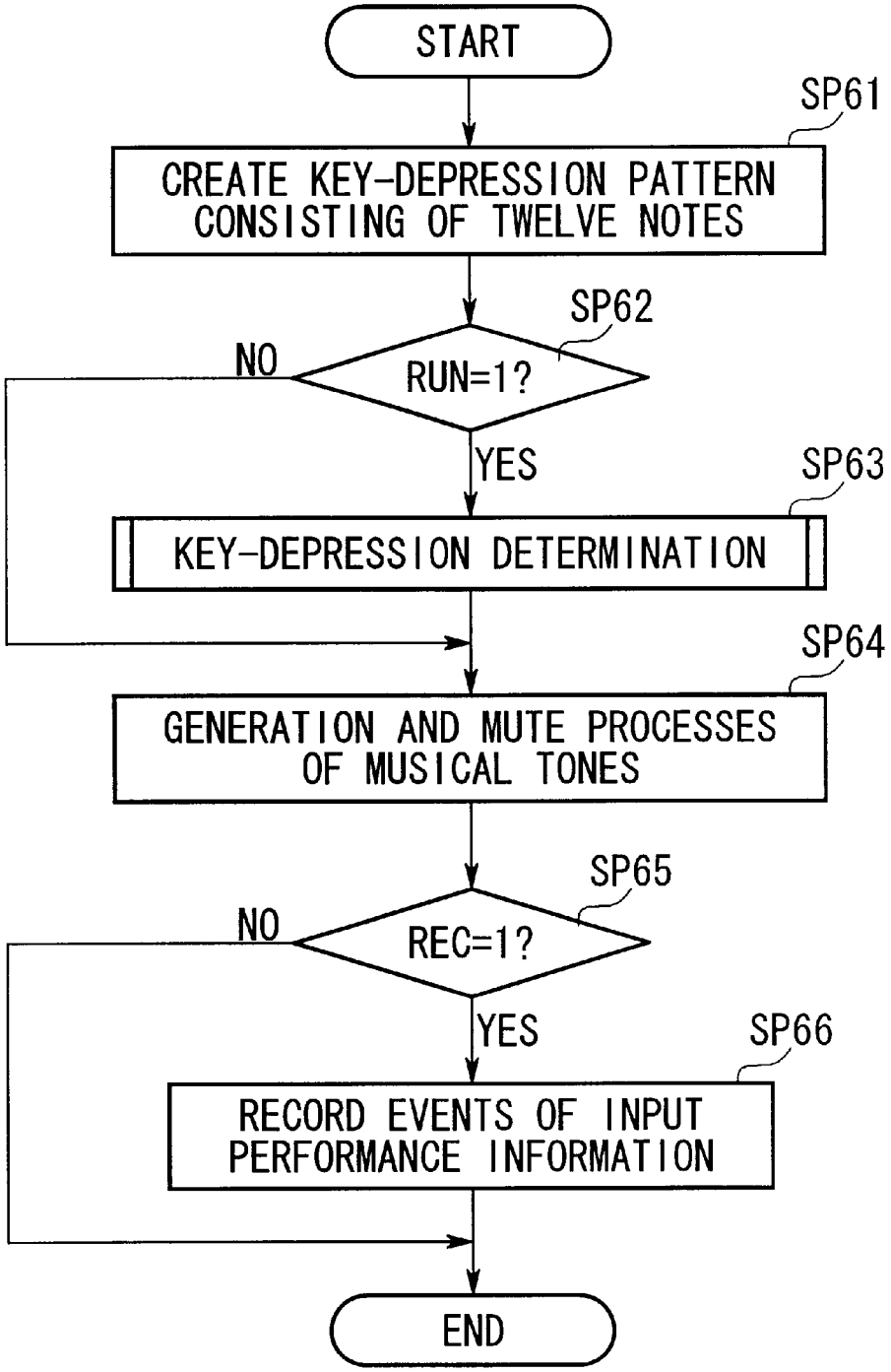
FIG. 16 is a flow chart showing a keyboard event interrupt routine.

When input performance information (i.e., key-on/off events on the keyboard 21) is supplied to the MIDI interface 11, an interrupt occurs in processing of the CPU 18, so that the system starts a routine shown in FIG. 16. In FIG. 16, a flow firstly proceeds to step SP61 in which the system creates a key-depression pattern with regard to keys of the keyboard 21 being presently depressed by the user. Strictly speaking, the key-depression pattern is created with regard to the keys on which key-on events occur but key-off events do not occur yet.

FIG. 18A shows an example of the key-depression pattern. Herein, the key-depression pattern consists of twelve bits, which respectively correspond to twelve notes (e.g., C, C#, D, . . . , A#, B). In the key-depression pattern, each of bits representing the notes corresponding to the keys being depressed is set to "1", while each of other bits is set to "0".

After completion of the step SP61 in FIG. 16, the flow proceeds to step SP62 in which a decision is made as to whether a RUN flag is set to "1" or not, in other words, a decision is made as to whether the performance information is presently placed under reproduction or not. If "YES", the flow proceeds to step SP63, in which the system calls a subroutine shown in FIG. 17. Roughly speaking, this subroutine is provided to make determination as to whether key-on/off events of the input performance information are correctly made or not in comparison with model performance information.

Specifics are described with reference to FIG. 17. A flow firstly proceeds to step SP71 in which a decision is made as to whether generation timings of key-on/off events of the input performance information emerge within a prescribed allowable time range (e.g., ±300 msec) in comparison with event timings of notes of the model performance information (regarding the chord part 4, 5) or not. If "YES", the flow proceeds to step SP72.

The present embodiment is designed such that the chord text section 150 stores chord names in connection with chords of the model performance information. Upon determination of a chord name, notes of its corresponding chord are being directly determined. In the present embodiment, a chord pattern consisting of twelve bits is created in advance with respect to each chord name and is stored in the external storage device 15. FIG. 18B shows an example of the chord pattern, which has substantially a same format of the aforementioned key-depression pattern shown in FIG. 18A.

In step SP72, the system reads out a chord pattern based on the chord text section 150 in prescribed event data of the model performance information. Then, the flow proceeds to step SP73 in which a decision is made as to whether the key-depression pattern matches with the chord pattern or not. If "YES", the flow proceeds to step SP74 in which the system records on a prescribed area (namely, performance evaluation buffer) of the RAM 16 such that the user makes a correct performing operation on the keyboard 21 with respect to the prescribed event data of the model performance information.

As described above, the step SP73 makes determination as to whether notes of the input performance information coincide with notes of the model performance information. The conventional technology frequently performs comparison between keycodes for evaluation of musical performance, so it requires a perfect match between input performance and model performance, regardless of modifications (e.g., inversion of chords) of musical performance. In contrast to the conventional technology, the present embodiment is characterized by performing comparison between notes of the input performance information and model performance information. For this reason, the present embodiment is capable of making determination that the user makes a correct performing operation on the keyboard 21 even if the user plays an inverted chord, which is slightly different from an original chord designated by the model performance information. Because, it is preferable for the user to play chords in inversion on some occasions, regardless of the model performance information. That is, the present embodiment is capable of making accurate evaluation on a variety of chord performance, which is played with variations such as inversion.

Figure 17:
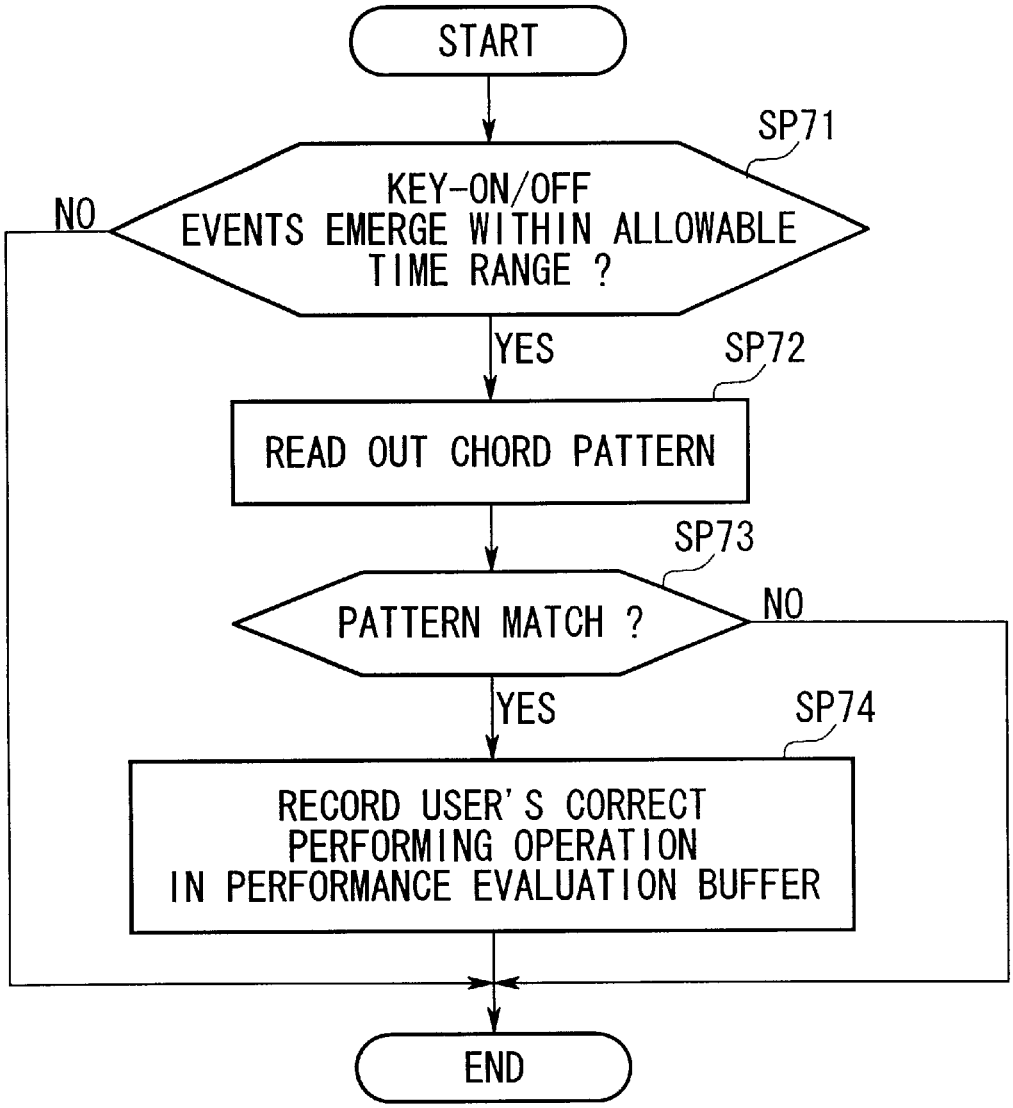
FIG. 17 is a flow chart showing a key-depression determination routine.

After completion of the aforementioned steps in FIG. 17, the flow reverts control to the keyboard event interrupt routine shown in FIG. 16. Incidentally, if all the generation timings of the key-on/off events of the input performance information emerge out of the allowable time range in comparison with the event timings of the notes of the model performance information, a decision result of the step SP71 is "NO". In addition, if the key-depression pattern does not match with the chord pattern, a decision result of the step SP73 is "NO". In that case, the system terminates the subroutine of FIG. 17 without performing the aforementioned process of the step SP74 in which the system records on the performance evaluation buffer such that the user makes a correct performing operation on the keyboard 21. Hence, the flow reverts control to the keyboard event interrupt routine shown in FIG. 16.

If under the prescribed condition where RUN=1, any one of the generation timings of the key-on/off events of the input performance information emerges within the allowable time range in comparison with the event timings of the notes of the model performance information (e.g., parts 4, 5), the system is capable of implementing the decision of the step SP73 although the user makes the input performance information containing the key-on/off events being made multiple times. That is, although the user makes error key operations multiple times as long as at least one of the generation timings of the key-on/off events of the input performance information emerges within the allowable time range in comparison with the event timings of the notes of the model performance information, if the user succeeds to make correct key operations at once, the system records on the performance evaluation buffer such that the user makes a correct performing operation on the keyboard 21, which is reflected on the score being marked for the user.

In step SP64, the system performs generation and mute processes on musical tones based on the key-on/off events of the input performance information. Then, the flow proceeds to step SP65 in which a decision is made as to whether a REC flag is set to "1" or not. If "YES", the system records the aforementioned events of the input performance information on a prescribed file of the external storage device 15. Thereafter, the system ends execution of the keyboard event interrupt routine shown in FIG. 16.

(8) Timer Interrupt Process After End of Reproduction

As described in the foregoing paragraph (7), the system of the present embodiment starts the timer interrupt process routine of FIG. 15 every prescribed time so that performance information is subjected to automatic reproduction. When the system reads end data (130, see FIG. 7) which represents termination of the performance information, a decision result of the foregoing step SP54 becomes "YES", so that the flow proceeds to step SP55.

In step SP55, the system reads out stored content of the performance evaluation buffer so as to evaluate and mark user's performance with a score on the basis of various evaluation factors, as follows:

(i) Number of times that the user makes error key operations in input performance information.

(ii) Number of times that the user makes correct key operations in input performance information.

(iii) A time required for the user to complete correct key depressions.

(iv) A level being set to the selected performance information.

Figure 5:
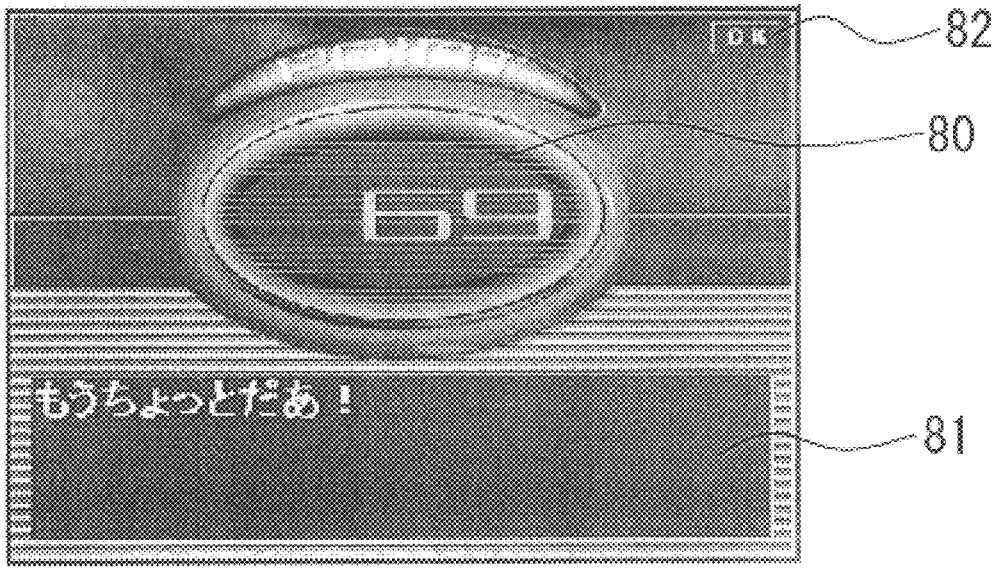
FIG. 5 shows an example of a screen image corresponding to a score window which is displayed on the screen.

An evaluation result (i.e., score being marked for the user's performance out of a hundred) is displayed on a score window shown in FIG. 5. Specifically, the score window provides a score display area 80 that shows a score being marked for the user. In addition, a message display area 81 shows a prescribed message corresponding to a character string in response to the score of the user. After recognition of the score, when the user clicks an OK button 82 with the mouse, the system closes the score window on the screen.

After completion of the aforementioned step SP55 in FIG. 15, the flow proceeds to step SP56 in which a decision is made as to whether the score of the user exceeds a predetermined value or not. If "YES", the flow proceeds to step SP57 so that an ENABLE flag is set to "1" with regard to the input performance information presently designated. This allows the user to record the input performance information by operating the record button 50. If "NO" in step SP56, the system skips the step SP57, so that the flow proceeds directly to step SP58.

In step SP58, comparison is made between the present score of the user and a highest point of score that the user gets in the past. If the present score of the user exceeds the highest point of score, the present score of the user is stored in a prescribed file of the external storage device 15 as a new highest point of score. Thus, if the ENABLE flag is set or the highest point of score is updated in this routine, new conditions are automatically set to the system. Hence, when the user opens the select window 60 again, the record indicators 66, 69, 72 and the score display areas 67, 70, 73 are displayed in accordance with the new conditions.

[D] Modifications

This invention is not necessarily limited to the aforementioned embodiment, hence, it is possible to provide a variety of modifications as follows:

(1) The present embodiment provides an independent file for storing plural pieces of performance information corresponding to plural levels in connection with a single genre name (or a title of a musical tune). However, it is possible to provide file management such that different pieces of information (e.g., chort text section 150, performance information of chord parts 4, 5), which differ from each other among the different levels, are stored in independent files respectively while same pieces of information (e.g., song text section 151, performance information of other parts other than the parts 4, 5) are stored in a common file, for example. In this case, reproduction is carried out such that the common file and any one of the independent files which are provided for the different levels respectively are subjected to readout. Because of the aforementioned file management, it is possible to reduce an overall storage capacity that is needed for storing all performance information.

(2) As the levels for the performance information, the present embodiment provides three steps, namely, the beginners' level, middle level and expert level. It is possible to modify the present embodiment such as to provide only two steps corresponding to the beginners' level and expert level. Or, it is possible to modify the present embodiment to provide four steps or more. In short, this invention is designed to provide plural types of performance information which differ from each other in difficulty of practice in connection with each one genre name.

(3) In the present embodiment, the performance information provide the chord text section 150 to specify the chord names. It is possible to exclude the chord text section 150 from the performance information so that the chord names are to be specified in response to the performance events 121, 122, . . . of the chord parts 4, 5. Specifying the chord names based on the performance events can be made with reference to keycodes which are contained in note-on/off events in the chord parts 4, 5.

(4) In the above, the keycodes correspond to serial numbers which are assigned to eighty-eight keys of the keyboard in a pitch ascending order. So, a remainder being produced by dividing the keycode by "12" designates a note within twelve notes. In addition, a 12-bit string is created such that each of bits corresponding to sustained notes (i.e., notes on which note-on events occur but note-off events do not occur yet) is set to "1" while each of other bits is set to "0". Then, the system searches a chord pattern (see FIG. 18B) that matches with the created bit string. Thus, it is possible to specify a chord name to be played at a given time during performance in progress.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A performance information selecting method using a computer display comprising the steps of:

reading out evaluation results which are respectively presented for a plurality of performance information each corresponding to musical performance being played in a past;

displaying on a screen of the computer display a list of tune names corresponding to the plurality of performance information as well as the evaluation results being arranged in connection with the plurality of performance information; and allowing a user to select any one of the plurality of performance information in response to a user's operation being made on the screen.

2. A performance information selecting method according to claim 1, further comprising the steps of:

displaying a first performance information and a second performance information in connections with one of the tune names on said list of tune names; and allowing a user to select either the first performance information or the second performance information, wherein the second performance information contains greater number of note-on events of chords and number of chord types as compared with the first performance information.

3. A performance information selecting method according to claim 2, wherein the first performance information is provided for a beginners' level and contains a number of chords that is less than the number of chords contained in the second performance information, which is provided for an expert level.

4. A performance control method comprising the steps of:

receiving an instruction to initiate or inhibit generation of sound being made by a user;

upon receipt of the instruction to initiate generation of sound, generating sound based on input performance information which is input by the user with reference to model performance information which is stored in advance;

evaluating the input performance information in comparison with the model performance information while the generation of sound progress on the input performance information; and upon receipt of the instruction to inhibit generation of sound, inhibiting the generation of sound based on the input performance information, so that the input performance information is evaluated in comparison with the model performance information.

5. A performance information recording method comprising the steps of:

evaluating input performance information in comparison with model performance information which is stored in advance;

based on an evaluation result presented for the input performance information, making determination whether to allow recording of next input performance information which is made by a user next to the input performance information; and recording the next input performance information on the basis of the determination.

6. A performance information evaluation method for evaluating input performance information in comparison with model performance information which is stored in advance, said performance information evaluation method comprising the steps of:

making determination whether at least one of generation timings of note-on events of the input performance information substantially matches with at least one of generation timings of note-on events of the model performance information within an allowable time range which is determined in advance;

in response to the determination, producing a chord pattern regarding a plurality of notes from the model performance information while producing a key-depression pattern regarding notes corresponding to the note-on events of the input performance information; and evaluating the input performance information based on a degree of match being detected between the chord pattern and the key-depression pattern.

7. A performance information evaluation method according to claim 6 wherein the allowable time range is set to ±300 msec or so.

8. A performance information evaluation method according to claim 6 wherein the chord pattern corresponds to a chord consisting of notes which are being simultaneously designated within prescribed twelve notes corresponding to twelve keys belonging to one octave of a keyboard while the key-depression pattern is made in connection with the twelve notes.

9. A chord performance practice and evaluation method using a computer display, comprising the steps of:

displaying on a screen of the computer display a main window that sequentially shows and updates at least a part of chord progression designating chords and generation timings of playing the chords with respect to chord parts of musical performance being reproduced for practice based on model performance information;

displaying on the screen a select window that provides a list of genre names for selection of a user as well as histograms representing evaluation results being made in a past with respect to the genre names respectively, wherein the histograms are independently provided for different levels being set for the user with respect to each of the genre names; and displaying a score window that shows a highest point of score being marked for input performance which the user makes with reference to the model performance information with respect to a specific genre name being selected by the user on the select window.

10. A chord performance practice and evaluation method according to claim 9 further comprising the step of:

sequentially displaying and updating a part of words of a song text, which is provided for the model performance information, in accordance with the chord progression on the main window.

11. A chord performance practice and evaluation method according to claim 9 further comprising the step of:

reproducing percussion sound in addition to the chords on the basis of the model performance information.

12. A chord performance practice and evaluation method according to claim 9 wherein the different levels correspond to a beginners' level and an expert level being set for the user, and wherein the beginners' level is simplified in chord performance to contain a relatively small number of chords being played by the user while the expert level is complicated in chord performance to contain a relatively large number of chords being played by the user.

13. A chord performance practice and evaluation method according to claim 9 wherein each of the histograms shows a score being marked for the input performance information made by the user out often grades, while the score window shows the score out of a hundred.

14. A chord performance practice and evaluation method according to claim 9 wherein when a user plays a chord on a keyboard consisting of keys being depressed, a key-depression pattern is correspondingly created to designate notes of depressed keys within prescribed twelve notes corresponding to one octave of the keyboard as the input performance information so that the input performance information is evaluated by comparing the key-depression pattern with a chord pattern that represents prescribed notes of the chord corresponding to prescribed keys, which should be simultaneously depressed on the keyboard, within the prescribed twelve notes.

15. A chord performance practice and evaluation method according to claim 14 wherein the input performance information is evaluated by marking a score in consideration of a degree of match being detected between the key-depression pattern and the chord pattern within an allowable time range.

16. A machine-readable media storing programs that cause a computer having a display to perform a performance information selecting method comprising the steps of:

reading out evaluation results which are respectively presented for a plurality of performance information each corresponding to musical performance being played in a past;

displaying on a screen of the display a list of tune names corresponding to the plurality of performance information as well as the evaluation results being arranged in connection with the plurality of performance information; and allowing a user to select any one of the plurality of performance information in response to a user's operation being made on the screen.

17. A machine-readable media of claim 16, said performance information selecting method further comprising the steps of:

displaying a first performance information and a second performance information in connection with one of the tune names on said list of tune names; and allowing a user to select either the first performance information or the second performance information, wherein the second performance information contains greater number of note-on events of chords and number of chord types as compared with the first performance information.

18. A machine-readable media storing programs that cause a computer to perform a performance control method comprising the steps of:

receiving an instruction to initiate or inhibit generation of sound being made by a user;

upon receipt of the instruction to initiate generation of sound, generating sound based on input performance information which is input by the user with reference to model performance information which is stored in advance;

evaluating the input performance information in comparison with the model performance information while the generation of sound progress on the input performance information; and upon receipt of the instruction to inhibit generation of sound, inhibiting the generation of sound based on the input performance information, so that the input performance information is evaluated in comparison with the model performance information.

19. A machine-readable media storing programs that cause a computer to perform a performance information recording method comprising the steps of:

evaluating input performance information in comparison with model performance information which is stored in advance;

based on an evaluation result presented for the input performance information, making determination whether to allow recording of next input performance information which is made by a user next to the input performance information; and recording the next input performance information on the basis of the determination.

20. A machine-readable media storing programs that cause a computer to perform a performance information evaluation method for evaluating input performance information in comparison with model performance information which is stored in advance, said performance information evaluation method comprising the steps of:

making determination whether at least one of generation timings of note-on events of the input performance information substantially matches with at least one of generation timings of note-on events of the model performance information within an allowable time range which is determined in advance;

in response to the determination, producing a chord pattern regarding a plurality of notes from the model performance information while producing a key-depression pattern regarding notes corresponding to the note-on events of the input performance information; and evaluating the input performance information based on a degree of match being detected between the chord pattern and the key-depression pattern.

21. A machine-readable media storing programs that cause a computer having a display to perform a chord performance practice and evaluation method comprising the steps of:

displaying on a screen of the display a main window that sequentially shows and updates at least a part of chord progression designating chords and generation timings of playing the chords with respect to chord parts of musical performance being reproduced for practice based on model performance information;

displaying on the screen a select window that provides a list of genre names for selection of a user as well as histograms representing evaluation results being made in a past with respect to the genre names respectively, wherein the histograms are independently provided for different levels being set for the user with respect to each of the genre names; and displaying a score window that shows a highest point of score being marked for input performance which the user makes with reference to the model performance information with respect to a specific genre name being selected by the user on the select window.

22. A performance information selecting apparatus comprising:

a readout for reading out evaluation results which are respectively presented for a plurality of performance information each corresponding to musical performance being played in a past;

a display for displaying on a screen a list of tune names corresponding to the plurality of performance information as well as the evaluation results being arranged in connection with the plurality of performance information; and a performance information selector for allowing a user to select any one of the plurality of performance information in response to a user's operation being made on the screen.

23. A performance information selecting apparatus according to claim 22, said apparatus further comprising:

a display for displaying a first performance information and a second performance information in connection with one of the tune names on said list of tune names; and a performance information selector for allowing a user to select either the first performance information or the second performance information, wherein the second performance contains greater number of note-on events of chords and number of chord types as compared with the first performance information.

* * * * *